US007168200B2

(12) United States Patent
Perez et al.

(10) Patent No.: US 7,168,200 B2
(45) Date of Patent: Jan. 30, 2007

(54) GUN SHELL CATCHER DEVICE

(76) Inventors: Kenneth Perez, 76246 Stafford Rd., Covington, LA (US) 70435; Laurence E. Burt, 423 Highway 22, Madisonville, LA (US) 70447

( * ) Notice: Subject to any disclaimer, the term of this patent is extended or adjusted under 35 U.S.C. 154(b) by 0 days.

(21) Appl. No.: 10/987,228

(22) Filed: Nov. 12, 2004

(65) Prior Publication Data

US 2006/0101699 A1 May 18, 2006

(51) Int. Cl.
*F41A 15/00* (2006.01)

(52) U.S. Cl. ..... 42/98; 89/33.4

(58) Field of Classification Search ..... 42/98; 89/33.4

See application file for complete search history.

(56) References Cited

U.S. PATENT DOCUMENTS 3,153,981 A * 10/1964 Brass ..... 89/33.4
3,881,268 A * 5/1975 Petersen ..... 42/98
4,110,927 A * 9/1978 Morris ..... 42/98
4,430,820 A * 2/1984 Marsh ..... 42/98
4,594,803 A * 6/1986 Muncy ..... 42/98
4,715,141 A * 12/1987 Kohnke ..... 42/98
4,903,426 A * 2/1990 Bammate ..... 42/98
4,959,918 A * 10/1990 Perez ..... 42/98
5,285,593 A * 2/1994 Bammate ..... 42/98
5,651,208 A * 7/1997 Benson ..... 42/98

* cited by examiner

*Primary Examiner*—Michelle Clement
(74) *Attorney, Agent, or Firm*—Keaty Professional Law Corporation

(57) ABSTRACT

A shell catcher for use with hand-held firearms adjustably detachably mounts on a side of the firearm for receiving and retaining spent shells expelled by the firearm. The shell catcher has a base, which mounts on a side of the firearm and a collapsible flexible housing, which is detachably pivotally mounted on the mounting base. The housing is stretched on a rigid frame that moves between a closed position when the shells are received in the housing and an open position allowing unobstructed view of the gun chamber. The spent shells are removed from the housing by means of opening the bottom of the housing or by removing the housing from the base.

16 Claims, 3 Drawing Sheets

GUN SHELL CATCHER DEVICE

BACKGROUND OF THE INVENTION

The present invention relates to firearms, and more particularly, to shell catchers attachable to hunting rifles, handguns, and other similar devices for collecting of empty shells expelled by the firearm.

During practice or competition, gun aficionados use a large amount of ammunition, resulting in a pile of empty shells, which fall from the gun to the ground and have to be collected and then disposed in a prescribed manner. A hunter may prefer to retrieve the shells so as to remove the scent of the foreign smell in a hunting area and not alert the prey to the hunter's presence in the area. During hunting, the shells may fall into tall grass where the shell collecting is tiresome and time-consuming.

The present invention contemplates provision of a shell catcher device that can be detachably mounted on a firearm, be it a handheld gun, hunting rifle, or other such weapon.

SUMMARY OF THE INVENTION

It is, therefore, an object of the present invention to provide a shell catcher device, which can be detachably mounted on a hand-held firearm for catching spent shells.

It is another object of the present invention to provide a shell catcher device that safely retains the shells in a compact bag attachable to the side of the firearm to make collection of the shells easy.

These and other objects of the present invention are achieved through a provision of shell catcher device that is detachably mountable on a side of a firearm adjacent an area, where the empty shells are expelled. The shell catcher device comprises a mounting base adjustably detachably securable on the hand-held firearm, and a housing for receiving the spent shells detachably pivotally mountable on the firearm. The housing comprises a soft, flexible, collapsible bag stretched on a frame and a securing plate, which detachably engages the mounting base.

A release pin carried by the frame allows to pivotally move the housing into an open position away from the firearm and into a closed position in contact with the firearm. The pin is spring loaded to normally retain the housing in the closed position.

BRIEF DESCRIPTION OF THE DRAWINGS

Reference will now be made to the drawings, wherein like parts are designated by like numerals and wherein.

DETAILED DESCRIPTION OF THE PREFERRED EMBODIMENT

Figure 1:
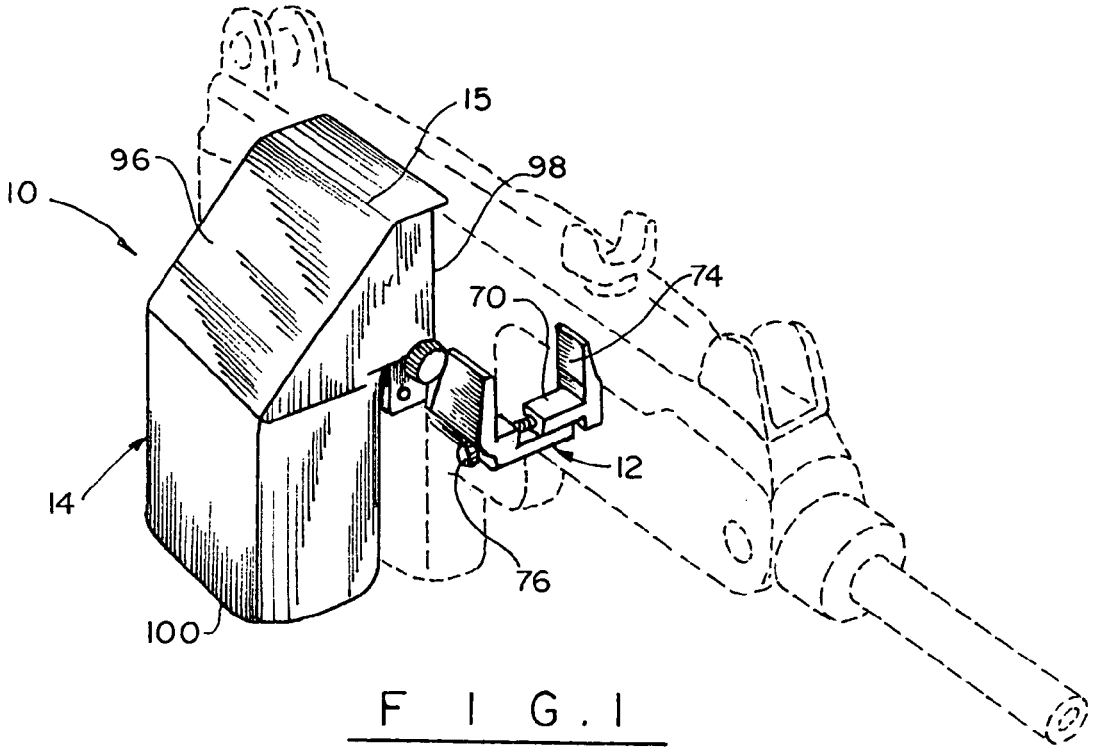
FIG. 1 is a perspective view of the gun shell catcher device in accordance with the present invention mounted on a handheld firearm.
Figure 2:
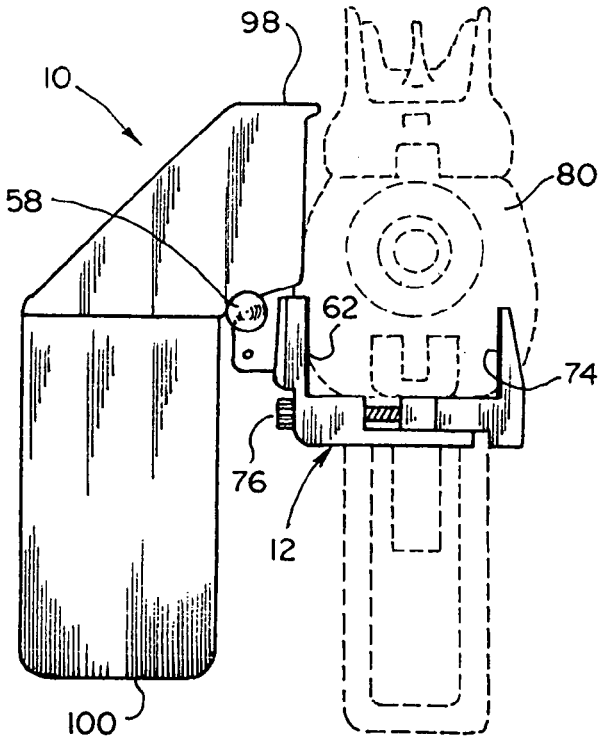
FIG. 2 is a front view of the gun shell catcher device of the present invention as mounted on the handheld firearm.
Figure 3:
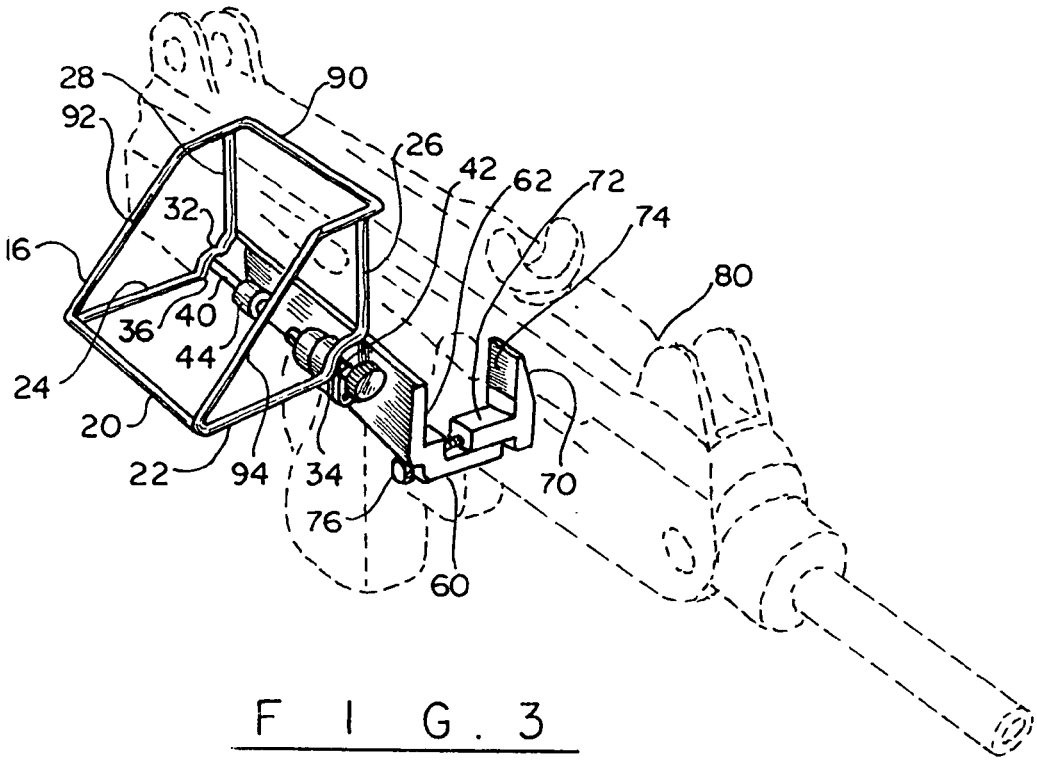
FIG. 3 is a perspective view of the frame of the shell catcher device of the present invention, with the collapsible housing removed for clarity.
Figure 4:
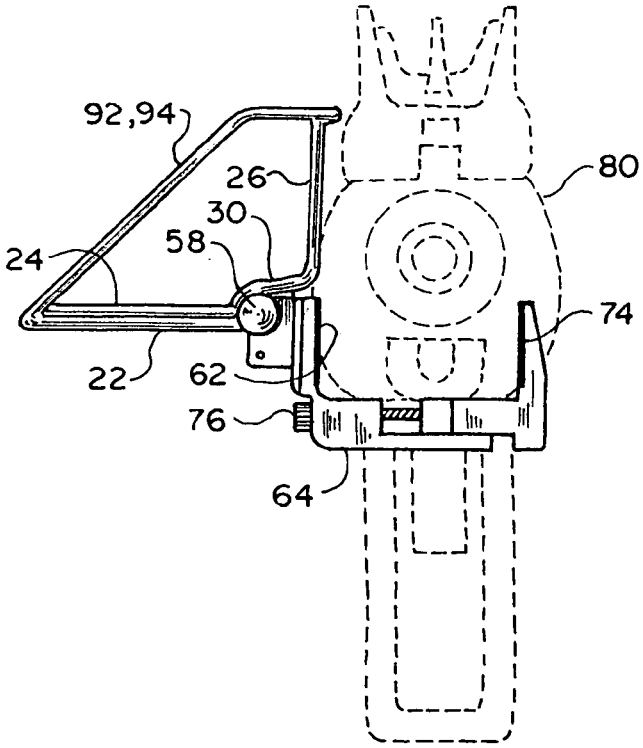
FIG. 4 is a front view of the shell catcher device of the present invention, with the collapsible housing removed for clarity, showing the front view of the frame and the mounting base, with the frame in a closed position.

Turning now to the drawings in more detail, numeral 10 designates the gun shell catcher device in accordance with the present invention. The shell catcher device comprises a base means 12 for mounting the device on a firearm and a shell receiving housing means 14. The housing means 14 comprises a collapsible member 15 stretched over a frame assembly 16, which is detachably secured on the base mounting means 12 and an enclosure 100. The frame assembly 16 comprises a lower inner supporting rod 18, an outer supporting rod 20, a first transverse supporting rod 22 and a second transverse supporting rod 24. The rods 18, 20, 22, and 24 define a generally rectangular supporting frame. Extending outwardly from the rods 22 and 24 is an upright support member 26 and 28, respectively. Each upright member 26 and 28 has a lower bent part 30 and 32, respectively. The part 30 (FIG. 4) extends inwardly toward the outer rod 20 and engages the proximate end 34 of the first transverse rod 22. The curved lower part 32 of the upright member 28 engages a corner plate 36 securely attached to a proximate end of the second transverse rod 24. One end of the lower inner supporting rod 18 is fixedly engaged with the corner plate 36. A second end of the rod 18 is secured to the proximate end 34 of the first transverse rod 22.

An upper inner supporting rod 40 extends between the upright rods 26 and 28 in a generally parallel relationship to the lower inner supporting rod 18 and the outer supporting rod 20. The rod 40 extends approximately from a point of intersection of the curved portions 30 and 32 with their respective upright rods 26, 28 in order to provide further stability to the collapsible housing member 14.

Figure 6:
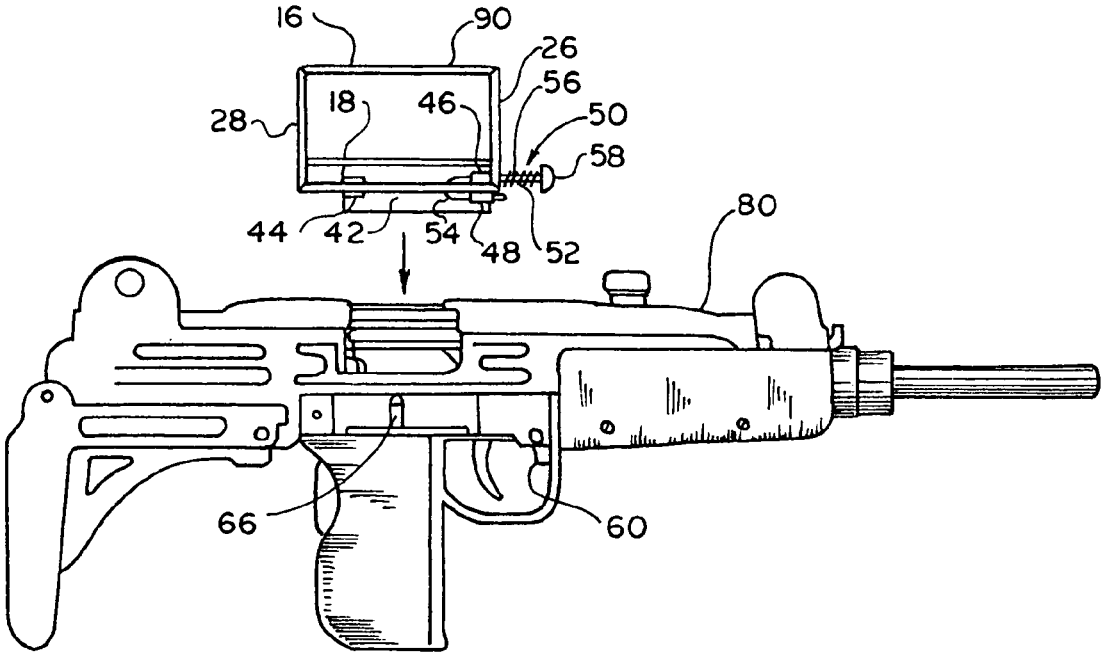
FIG. 6 is a side view of the shell catcher device of the present invention, with the frame detached and the mounting base secured on the side of the gun.

The device 10 further comprises a means for pivotally moving the frame of the housing means in relation to the first member, said means comprising an elongated engagement plate 42 secured on the rigid frame assembly 16 and adapted for detachable engagement with the first member, at least one sleeve 44 mounted on said engagement plate and a release pin 50 releasably engageable with said at least one sleeve 44. The sleeve 44 is sized and configured to receive a portion of the inner supporting rod 18 therethrough. A pair of spaced apart engagement sleeves 46 and 48 (FIG. 6) is secured a distance from the sleeve 44. The release pin 50 is slidably engaged within the sleeves 46 and 48. The release pin 50 comprises a generally J-shaped member having a first portion 52 and a curved portion 54. The curved portion 54 is engaged within the sleeves 46 and 48, while a compression spring 56 is mounted about the portion 52. The compression spring 56 urges against a head 58 of the release pin 50 on one end, and against the sleeve 46—at its opposite end.

Figure 5:
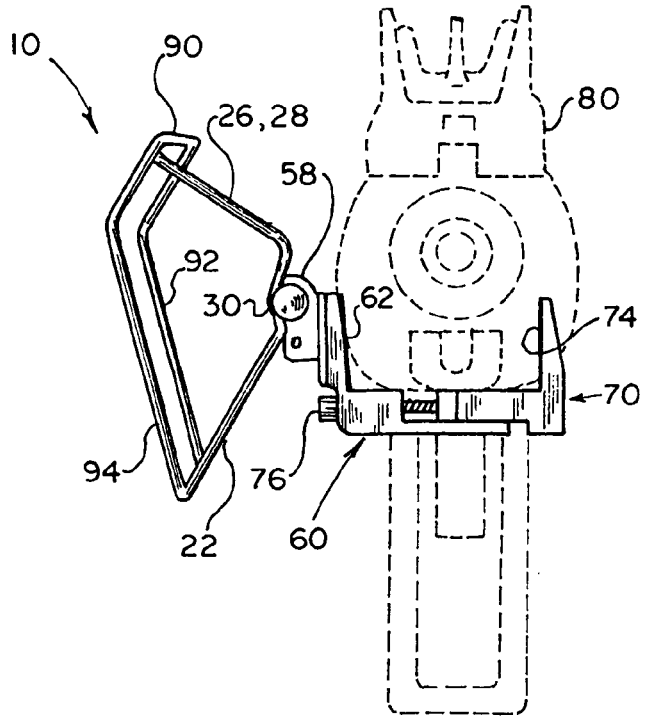
FIG. 5 is a front view of the frame of the shell catcher device, with the frame in an open position.

The release pin 50 allows the frame assembly 16 to move into a locked, close position in close proximity to a firearm 80 as shown in FIGS. 1, 2, 3, and 6 and to pivot into an open position as shown in FIG. 5. When the user pushes on the head 58, the free end of the release pin 50 is released from the sleeve 48, allowing a pivotal movement of the frame assembly 16 about an axis formed by the rod 18. To bring the frame assembly 16 into a closed position, the user again pushes on the head 58, against the force of the compression spring 56 and then moves the free end of the release pin 50 into a sliding engagement with the sleeve 48.

The device 10 further comprises a means for detachably engaging the housing means through the engagement plate 42 with the mounting assembly through the mounting base 60. The mounting base 60 is comprised of adjustably movable members mounted in a sliding relationship to each other. The first mounting base member has at least a portion having an L-shaped configuration in cross section. Of course, other cross-sectional configurations may be employed depending on the style and shape of the gun. The first mounting base member has an upright portion 62 and a horizontal portion 64. The upright portion 62 is provided with a leaf spring 66 (FIG. 6) which is securely attached to the exterior surface of the upright portion 62. The engagement plate 42 is adapted for sliding between the leaf spring 66 and the exterior surface of the portion 62, thus detachably engaging the frame 16 on the firearm 80.

The second mounting base member 70 has a portion having a generally L-shaped cross section, with a horizontal part 72 and a vertical upright part 74. As mentioned above, other cross-sectional configurations may be employed depending on the style and shape of the gun, on which the shell catching device of the present invention is to be positioned. The horizontal part 72 of the mounting base member 70 slidably engages the horizontal portion 64. The horizontal part 72 slides for a pre-determined adjustable distance along the top of the horizontal portion 64 of the first mounting base member. An engagement pin 76 extends through the vertical portion 62 of the first base member and engages with the horizontal part 72 of the second mounting base member 70. The engagement pin 76 may be a threaded bolt, which is rotated to allow the vertical part 74 move toward and away from the vertical portion 62.

When positioned on a firearm 80, the upright part 74 engages one side of the firearm body, while the second upright portion 62 engages the opposite side of the firearm body. Due to the sliding engagement between the two portions of the mounting base 60, the shell catching device of the present invention can accommodate different width firearms, assuring that the shell catching device 10 is securely positioned and tightly engages the firearm 80. As a result, the shell catching device 10 retains its firm engagement with the firearm 80 whether the shell catching device is in a closed or open position, or the housing is removed from the base completely.

The frame assembly 16 further comprises an upper inner rod 90, which is secured to upper ends of the upright members 26 and 28. Connecting rod members 92 and 94 extend between the rod 90 and the outer supporting rod member 20, thereby forming a cage for stretching of the collapsible member 15 thereon. A first panel 96 of the collapsible member 15 is stretched between the upper rod member 90 and the lower outer rod member 20. A second panel 98 is stretched between the rod members 26, 94, and 22, while the third panel member is stretched between the rod members 28, 92, and 24. The third panel member is a mirror image of the panel member 98.

A bag-shaped enclosure 100 is suspended from the rods 20, 22, 18, and 24. The enclosure 100 is fixedly attached to the panels 96, 98 and a third panel (not shown). The enclosure 100 serves as a housing for receiving spent shells expelled by the firearm 80. The side of the housing 14 opposite the panel 96 is open, allowing the spent shells to be received by the housing 14 and delivered by gravity into the enclosure 100. The collapsible housing body 14 can be formed from a strong flexible, collapsible material such as canvas or other fabric and is designed to withstand the weight of the shells housed within the closure 100.

In operation, the user positions the mounting base 60 on the firearm 80 and tightens the screw or bolt 76 such that the vertical part 74 and vertical portion 62 tightly engage opposite sides of the firearm 80. The user then engages the engagement plate 42 between the leaf spring 66 and the mounting base 60, thereby suspending the housing means 14 stretched on the frame assembly 16 on the firearm 80. The protective cover of the panel 96 extends above and over the opening from which the shells are expelled. After the shooting competition or the hunt is over, the user can easily detach the housing 14 by pulling the frame 16 upward and releasing the plate 42 from its engagement on the mounting base 60. The mounting base 60 can then be disengaged from the firearm 80 and stored separately from the housing 14, if desired. The shells are then removed from the housing 14 and disposed of in the desired manner.

Many changes and modifications can be made in the apparatus of the present invention without departing from the spirit thereof. We therefore pray that our rights to the present invention be limited only by the scope of the appended claims.

We claim:

1. A shell catcher device for a hand-held firearm, comprising:

a collapsible shell-receiving housing means having an open end adapted for receiving spent shells expelled from the firearm, said housing means comprising a rigid frame, a flexible collapsible body stretched on said frame, and an engagement plate configured for detachable engagement with a mounting assembly;

a base detachably securable on a side of the firearm;

a mounting assembly for detachably adjustably mounting the housing means on the base, said mounting assembly comprising a first member adapted for engaging one side of the firearm and a second member adapted for engaging an opposite side of the firearm, said first member and said second member being selectively slidably engaged with each other along lower ends of the first member and the second member to allow adapting the mounting assembly to a configuration of the firearm; and a means for pivotally moving the housing means in relation to the firearm.

2. The device of claim 1, further comprising a means for detachably engaging the housing means with the mounting assembly.

3. The device of claim 1, wherein said mounting assembly comprises an upright portion having an inner surface contacting the firearm when the shell catcher device is mounted on the firearm and an exterior surface, and wherein a spring member is mounted on the exterior surface of the upright portion.

4. The device of claim 3, wherein said engagement plate is configured for detachable positioning between said elongated plate and the spring member.

5. The device of claim 1, wherein said engagement plate carries at least one sleeve on a side adjacent the frame, and wherein a release pin member is releasably engaged with said sleeve.

6. The device of claim 5, wherein said release pin carries a compression spring normally urging the release pin into engagement within said at least one sleeve.

7. The device of claim 6, wherein said frame is adapted for a pivotal movement away from the firearm when the release pin is disengaged from said at least one sleeve.

8. A shell catcher device for a hand-held firearm, comprising:

a collapsible shell receiving housing means having an open end adapted for receiving spent shells expelled from the firearm;

a base detachably securable on a side of the firearm;

a mounting assembly for detachably adjustably mounting the housing means on the base, said mounting assembly comprising a first member adapted for engaging one side of the firearm and a second member adapted for engaging an opposite side of the firearm, said first member and said second member being selectively slidably engaged with each other along their lower ends to allow adapting the mounting assembly to a configuration of the firearm, wherein said first member carries a horizontal portion transversely connected to a lower edge thereof, said second member carries a horizontal part transversely connected to a lower edge thereof, said horizontal portion and said horizontal part are slidably engaged with each other and extend below a bottom of the firearm; and a means for pivotally moving the housing means in relation to the firearm.

9. The device of claim 8, wherein said mounting means comprises a means for retaining said first member and said second member in a mutually aligned position.

10. The device of claim 9, wherein said means for retaining said first member and said second member in a mutually aligned position comprises a threaded pin secured to said first member and said second member.

11. The device of claim 8, wherein said collapsible body has a normally closed bottom for retaining the shells expelled by the firearm.

12. A shell catcher device for a hand-held firearm, comprising:

a shell receiving housing means having a collapsible flexible body stretched on a rigid frame, said body provided with an open end adapted for receiving spent shells expelled from the firearm;

a base detachably securable on the firearm;

a mounting assembly means for detachably adjustably mounting the housing means on the base, said mounting assembly comprising a first member having a vertical portion contacting a side of the firearm and a horizontal portion, and a second member having a vertical part contacting an opposite side of the firearm when the shell catcher device is mounted on the firearm and a horizontal part, said horizontal portion and said horizontal part being slidably engaged with each other below a bottom of the firearm when the shell catcher device is mounted on the firearm; and a means for pivotally moving the frame of the housing means in relation to the first member, said means comprising an engagement plate secured on the rigid frame and adapted for detachable engagement with the first member, at least one sleeve mounted on said engagement plate and a release pin releasably engageable with said at least one sleeve.

13. The device of claim 12, further comprising a means for detachable engagement of the frame to the mounting means.

14. The device of claim 13, wherein said means for detachable engagement comprises a spring member carried by the first member of the housing means, and wherein said engagement plate is adapted for positioning between the spring member and said first member, said spring member normally retaining said engagement plate in contact with the first member of the mounting means.

15. The device of claim 12, wherein said mounting means comprises a means for retaining said first member and said second member in a mutually aligned position.

16. The device of claim 15, wherein said means for retaining said first member and said second member in a mutually aligned position comprises a threaded pin secured to said first member and said second member.

* * * * *